US008111205B1

(12) United States Patent
Tam et al.

(10) Patent No.: US 8,111,205 B1
(45) Date of Patent: Feb. 7, 2012

(54) MAST CLAMP CURRENT PROBE (MCCP) INSERTION LOSS DETERMINING METHODS AND SYSTEMS

(75) Inventors: Daniel W. S. Tam, San Diego, CA (US); James C. Logan, San Diego, CA (US); Shing Ted Li, San Diego, CA (US); Paul Michael McGinnis, San Diego, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 587 days.

(21) Appl. No.: 12/407,034

(22) Filed: Mar. 19, 2009

(51) Int. Cl.
*H01Q 7/08* (2006.01)

(52) U.S. Cl. ..... 343/788; 343/703; 343/720; 343/742; 343/856

(58) Field of Classification Search ..... 343/703, 343/720, 742, 787, 788, 856, 752, 846
See application file for complete search history.

(56) References Cited

U.S. PATENT DOCUMENTS 5,014,068 A 5/1991 Abramo et al.
5,633,648 A * 5/1997 Fischer ..... 343/788
5,796,369 A * 8/1998 Henf ..... 343/752
6,492,956 B1 * 12/2002 Fischer et al. ..... 343/788
6,577,155 B2 * 6/2003 Stewart et al. ..... 326/32
6,873,827 B1 3/2005 Wright
6,940,289 B2 * 9/2005 Hyacinthe et al. ..... 324/534
7,239,150 B2 * 7/2007 Troxler et al. ..... 324/643
2004/0131198 A1 * 7/2004 Watanabe et al. ..... 381/71.7

* cited by examiner

*Primary Examiner* — Douglas W Owens
*Assistant Examiner* — Chuc Tran
(74) *Attorney, Agent, or Firm* — Kyle Eppele; J. Eric Anderson

(57) ABSTRACT

Methods and systems for determining insertion loss for a mast clamp current probe (MCCP) coupled to a monopole antenna are disclosed. An exemplary method includes determining a first power radiated by the monopole antenna across a first range of frequencies while driving the monopole antenna using a base-feed arrangement to produce a first power-frequency measurement, determining a second power radiated by the monopole antenna across the first range of frequencies while driving the monopole antenna using an MCCP-feed arrangement to produce a second power-frequency measurement and to determine impedance mismatch (MM), and determining insertion loss using the first power-frequency measurement, the second power-frequency measurement and the impedance mismatch.

15 Claims, 8 Drawing Sheets

MAST CLAMP CURRENT PROBE (MCCP) INSERTION LOSS DETERMINING METHODS AND SYSTEMS

FEDERALLY-SPONSORED RESEARCH AND DEVELOPMENT

This invention (Navy Case No. 099086) is funded by the United States Department of the Navy. Licensing inquiries may be directed to the Office of Research and Technical Applications, Space and Naval Warfare Systems Center, San Diego, Code 72120, San Diego, Calif., 92152; voice 619-553-2778; email T2@spawar.navy.mil.

BACKGROUND

1. Field

This disclosure relates to communication systems. More particularly, this disclosure relates to determining signal insertion loss for antenna systems.

2. Background

A Mast Clamp Current Probe (MCCP) is a device operable to couple various communication systems to various ship structures, such as a ship's mast, in order to transform such structures into an operable antenna. Mast Clamp Current Probes have been successfully demonstrated to produce broadband receive antennas using available shipboard structures, such as stub masts. The receive MCCP is robust, low maintenance, and affordable.

However, the transmit MCCP is currently under development. A key design consideration for the transmit MCCP is the insertion loss, and a number of attempts have been made to quantize the loss using empirical and numerical techniques, with mixed success.

The empirical approach is to infer system efficiency by measuring the radiated field at a distance and comparing the test antenna to a standard. Such measurements are typically made in the open environment and must be performed very carefully to achieve a modicum of accuracy—and even then test results are often subject to various interpretations.

Numerical techniques involve the art of developing a model for the MCCP core and principal surroundings in sufficient detail to predict antenna performance. Numerical techniques have provided much needed insight into the design process, but ultimately the results rest on the accurate measurement of material characteristics. As the MCCP materials are typically anisotropic and frequency dependent, any measurement of these properties is an art form in itself. Thus, new approaches to determining MCCP insertion loss are desirable.

SUMMARY

The foregoing needs are met, to a great extent, by the present disclosure, wherein systems and methods are provided that in some embodiments provide for a broadband antenna composed of open wires disposed over a ship's mast.

In various embodiments, a method for determining insertion loss for a mast clamp current probe (MCCP) coupled to a monopole antenna includes determining a first power radiated by the monopole antenna across a first range of frequencies while driving the monopole antenna using a base-feed arrangement to produce a first power-frequency measurement, determining a second power radiated by the monopole antenna across the first range of frequencies while driving the monopole antenna using an MCCP-feed arrangement to produce a second power-frequency measurement and to determine impedance mismatch (MM), and determining insertion loss using the first power-frequency measurement, the second power-frequency measurement and the impedance mismatch.

In various other embodiments, a system for determining insertion loss for a mast clamp current probe (MCCP) coupled to a monopole antenna includes a first testing means for determining a first power radiated by the monopole antenna across a first range of frequencies while driving the monopole antenna using a base-feed arrangement to produce a first power-frequency measurement, a second testing means for determining a second power radiated by the monopole antenna across the first range of frequencies while driving the monopole antenna using an MCCP-feed arrangement to produce a second power-frequency measurement and to determine impedance mismatch (MM), and computer equipment operable to determine insertion loss using the first power-frequency measurement, the second power-frequency measurement and the impedance mismatch.

In various other embodiments, a system for determining insertion loss for a mast clamp current probe (MCCP) coupled to a monopole antenna includes a base-feed test set that includes a signal generator and a current measuring device, wherein the signal generator is operable to drive the monopole antenna across a first range of frequencies using a base-feed arrangement while the current measuring device is operable to measure a first current of the monopole antenna, wherein a first power-frequency measurement may be determined using the first measured current, an MCCP-feed test set that also includes a signal generator and a current measuring device, wherein the signal generator is operable to drive the monopole antenna across a first range of frequencies via the MCCP while the current measuring device is operable to measure a second current of the monopole antenna, wherein a second power-frequency measurement may be determined using the second measured current, and wherein the MCCP-feed test set is operable to determine impedance mismatch (MM), and computer equipment operable to determine insertion loss using the first measured current, the second measured current and the impedance mismatch.

DETAILED DESCRIPTION

The disclosed methods and systems below may be described generally, as well as in terms of specific examples and/or specific embodiments. For instances where references are made to detailed examples and/or embodiments, it should be appreciated that any of the underlying principles described are not to be limited to a single embodiment, but may be expanded for use with any of the other methods and systems described herein as will be understood by one of ordinary skill in the art unless otherwise stated specifically.

A Mast Clamp Current Probe (MCCP) is a device operable to couple various communication systems to various ship structures, such as a ship's mast, in order to transform such structures into an operable antenna. However, transmit MCCPs must be carefully characterized to be a useful part of a ship's communication systems.

Figure 1:
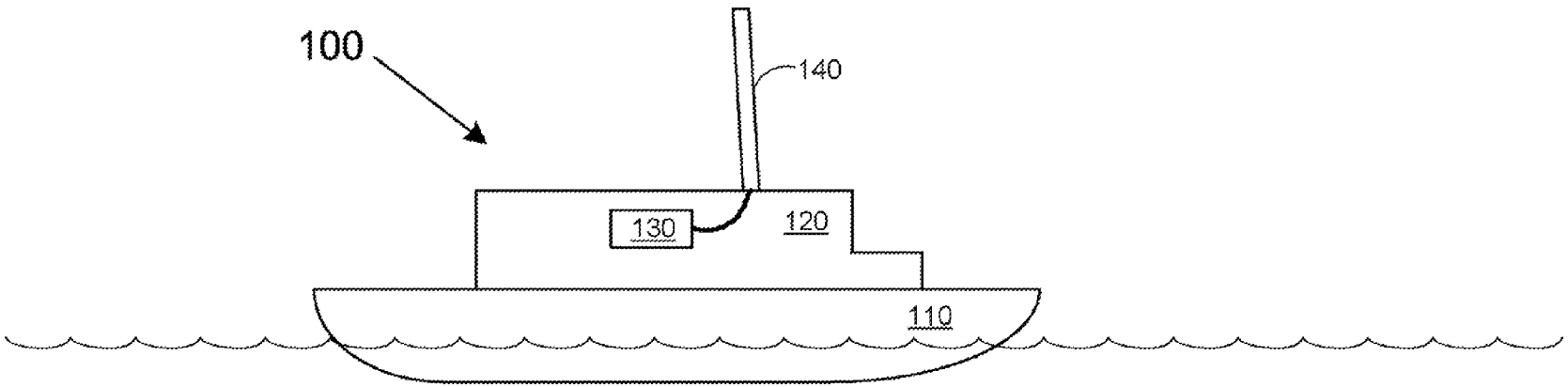
FIG. 1 is an illustration of a seagoing craft with an exemplary mast.

FIG. 1 is a diagram illustrating a ship 100 having a hull 110, a superstructure 120 and mast 140. In the present example, an MCCP (not shown in FIG. 1) may be used to convert the mast 140 to act as a monopole antenna for communication system 130, which may include one or both of transmit and receive capabilities.

Figure 2:
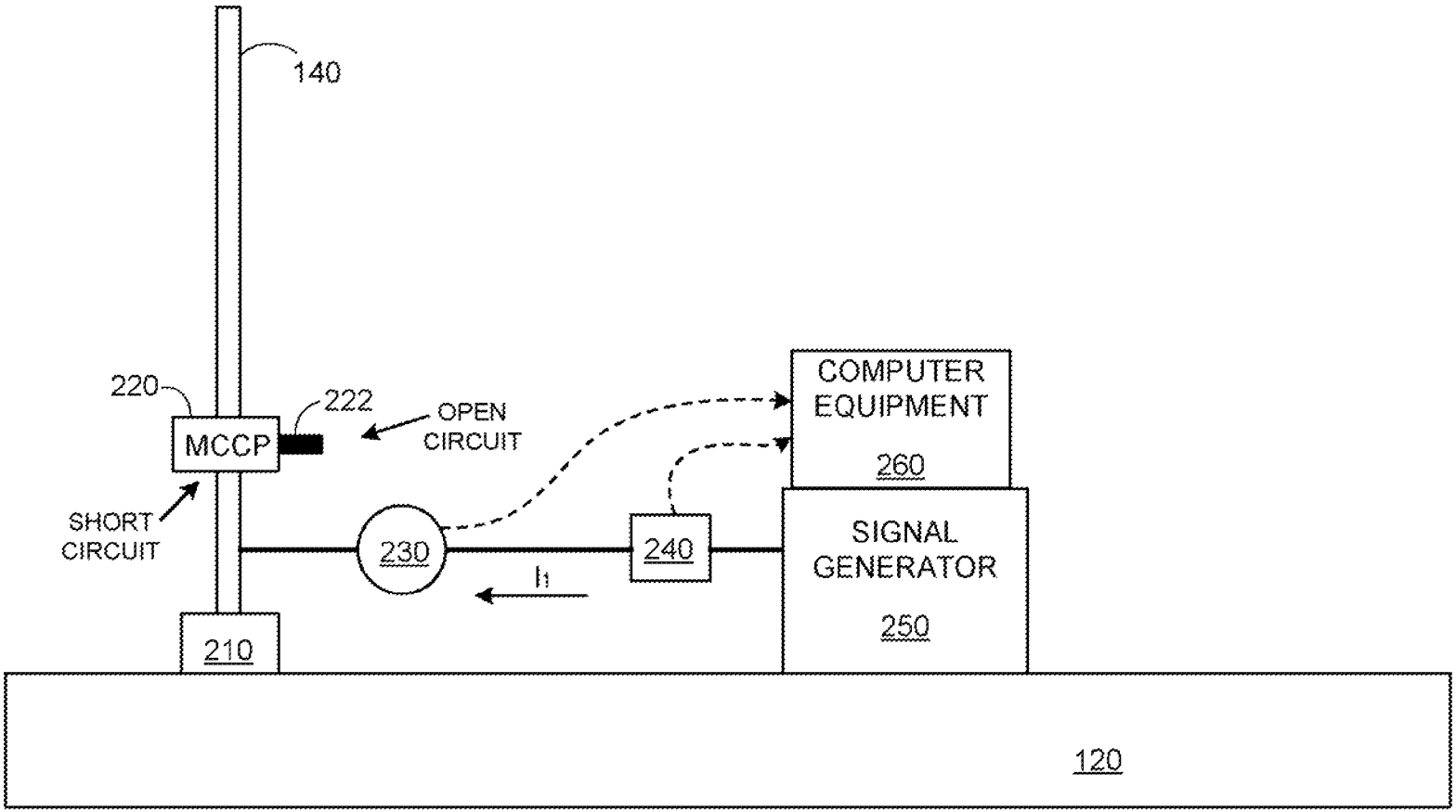
FIGS. 2 and 3 depict two separate testing arrangements for evaluating MCCP insertion loss for the exemplary mast of FIG. 1.
Figure 3:
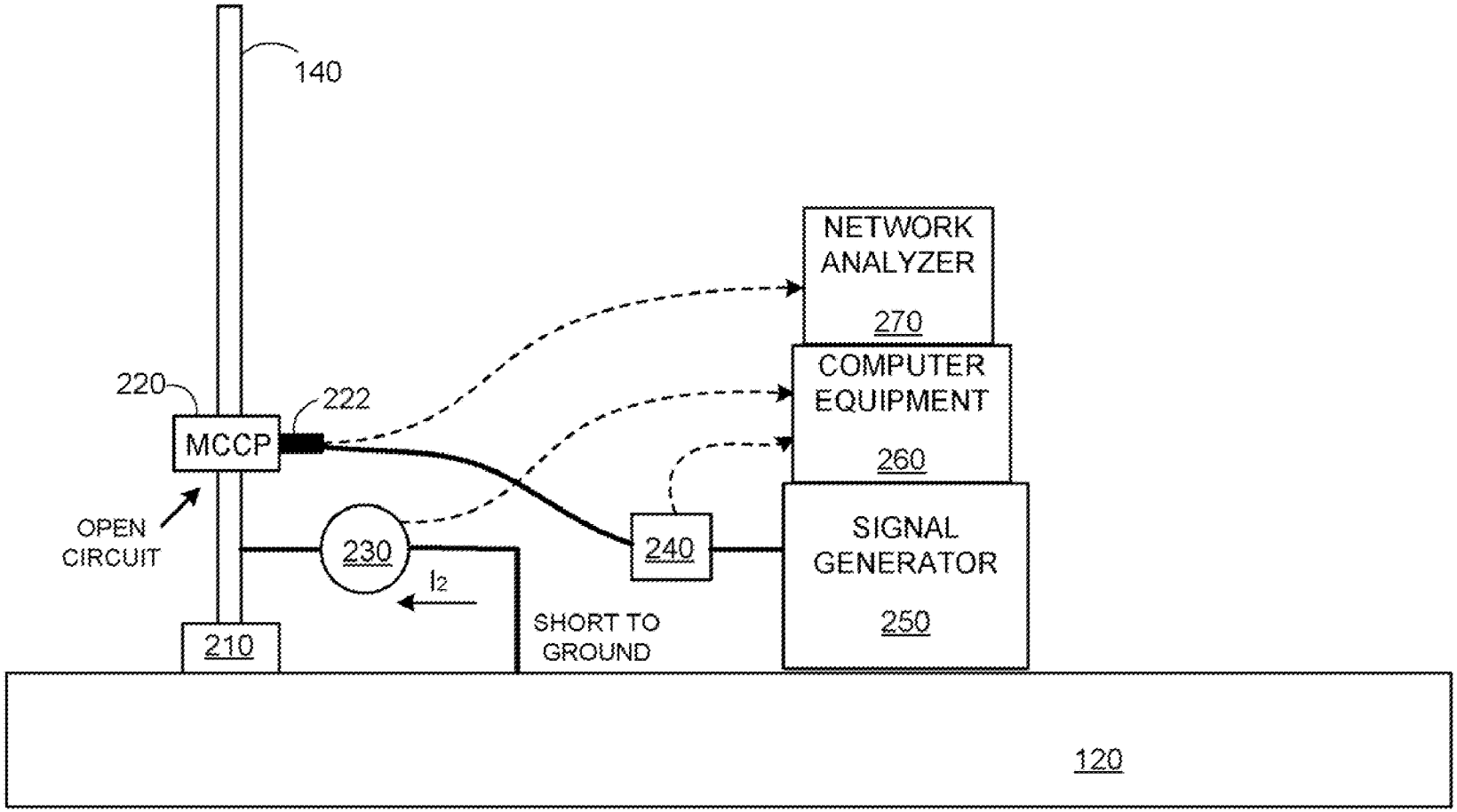

FIGS. 2 and 3 depict two separate testing arrangements useful for evaluating MCCP insertion loss for the exemplary mast/monopole antenna 140 of FIG. 1. For both configurations of FIG. 2 and FIG. 3, the geometric configuration of the mast/monopole antenna 140 and the MCCP 220 may be identical. Similarly, the electromagnetic coupling between MCCP and mast/monopole antenna 140 may be the same in both cases.

For the present example, the mast/monopole antenna 140 may range in height from about 20 to 90 feet long, and is secured to superstructure 120 at base 210. An MCCP 220 having a feed point terminal 222 may be placed a short distance, e.g., five feet, above the base 210 to accommodate connection of a radio frequency (RF) ammeter 230 between the base 210 and the MCCP 220. In one embodiment, the MCCP 220 may be placed at the lowest point permissible.

Continuing, the length of the mast/monopole antenna 140 (hereinafter just "monopole antenna") may be selected for convenience such that, over a particular swept frequency range, the maximum current on the monopole antenna 140 will occur at the base 210. Hence, in various embodiments, the monopole antenna 140 may be limited to not much longer than a half wavelength at the highest frequency of interest, and long enough at the lowest frequency of interest to provide an adequate signal-to-noise ratio (SNR).

The exemplary test equipment used in the present example includes a wideband current sampling Pearson probe and voltmeter to function as the RF ammeter 230, various (optional) resistive pads (or attenuators) 240, a signal generator 250 capable of producing a swept frequency, computer-based equipment 260, a network analyzer 270 and an assortment of cables and connectors.

For the configuration of FIG. 2, the radiated power of the monopole antenna 140 is determined when the monopole is driven from the signal generator 250 in what may be thought of as the conventional "base-fed" method. Thus, the configuration of FIG. 2 will be hereafter referred to as a "base-feed" or "base-fed" configuration.

For the configuration of FIG. 3, however, the power radiated by the monopole antenna 140 is determined when the monopole is driven from the signal generator through the MCCP. Thus, the configuration of FIG. 3 will be hereafter referred to as a "MCCP-feed" or "MCCP-fed" configuration.

Referring back to FIG. 2, the base-feed testing configuration is shown with signal generator 250 coupled to the monopole antenna 140 at a point between the base 210 and the MCCP 220 via a first cable with the RF ammeter 230 and resistive pads 240 placed there between in series. This configuration may be used to measure and store current $I_1$ delivered to the monopole antenna 140 by the signal generator 250.

The exemplary monopole antenna 140 dimensions for the present example have been appropriately selected for the frequency range of interest as per the above guidance. The pad 240 is optional and is only suggested as a means to isolate the signal generator 250 from the inherent load of the monopole antenna 140. A constant power output by the signal generator 250 is desirable. The measurement of current $I_1$ can be done with the input MCCP-feed point, or primary, terminal 222 left open (unconnected to anything) and a secondary terminal (not shown in FIG. 2) of the MCCP 220 short-circuited. By way of example, one way of short-circuiting the secondary terminal would be to use electrical conductive tape to span the space gap 434 (described below in association with FIG. 4B). In this configuration, no current will flow through the MCCP 220 during testing.

In operation, the signal generator 250 may be made to sweep across a first frequency range of interest, e.g., 2 MHz to 30 MHz. As power is fed to the monopole antenna 140, the RF ammeter 230 can measure current $I_1$, and feed its current measurement signals to the computer-based equipment 260. In turn, the computer-based equipment 260 can receive the current measurement signals, as well as the signals produced by the signal generator 250 (for reference). Note that the power radiated by monopole antenna 140 is proportional to the square of current $I_1$.

Continuing to FIG. 3, which depicts the MCCP-feed configuration, the test equipment may be re-arranged such that the signal generator 250 and pad 240 are removed from the RF ammeter 230 such that the RF ammeter 230 is connected close to the base of the monopole antenna 140 on one side and shorted to the superstructure 120 (or whatever other structure may qualify as ground) on the other side. The pad 240 may be reconfigured to be in series between the signal generator 250 and the feed terminal 222 so as to allow the signal generator 250 to provide a signal to the MCCP 220. While not shown in FIG. 3, the second terminal of MCCP 220 is open-circuit/isolated with respect to the monopole antenna 140.

In operation, the signal generator 250 again may sweep across the first frequency range. During the sweep, as power is fed to the MCCP 220, the RF ammeter 230 can measure current $I_2$, and feed its current measurement signals to the computer-based equipment 260. In turn, the computer-based equipment 260 can receive the current measurement signals, as well as the signals produced by the signal generator 250. Again, the power radiated by monopole antenna 140 is proportional to the square of current $I_2$. Also, in this configuration the network analyzer 270 may be used to measure impedance. The impedance measurement may then be used to determine impedance mismatch (MM).

The difference between the current measurements for the base-feed and MCCP-feed configurations ($=20 \log I_1 - 20 \log I_2$) represents the total system loss when the monopole antenna 140 is driven through the MCCP 220. Using the total system loss and the impedance mismatch, the insertion loss may be calculated as $=20 \log I_1 - 20 \log I_2 - MM$.

Figure 4A:
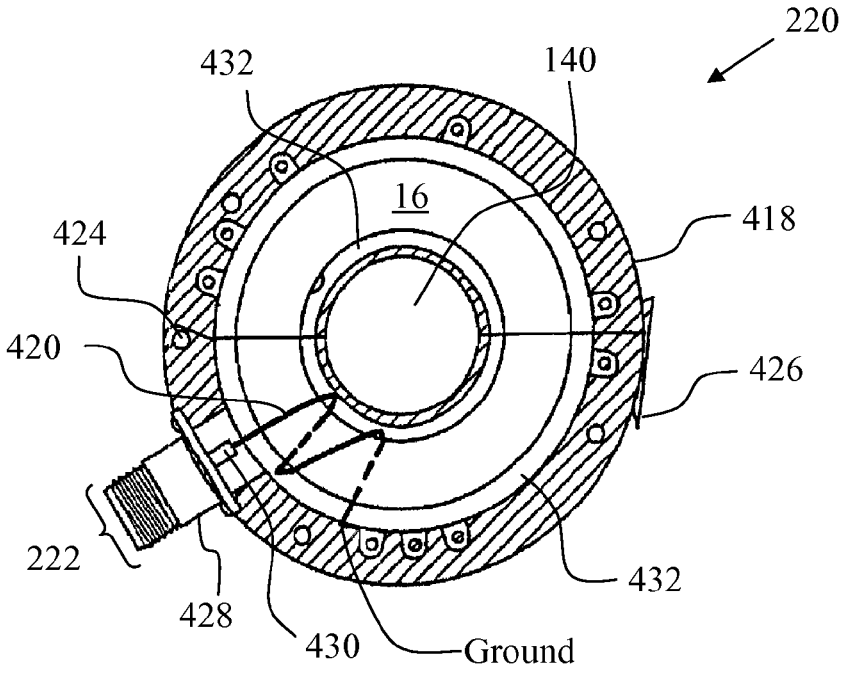
FIGS. 4A-4C depict details of an exemplary MCCP.
Figure 4B:
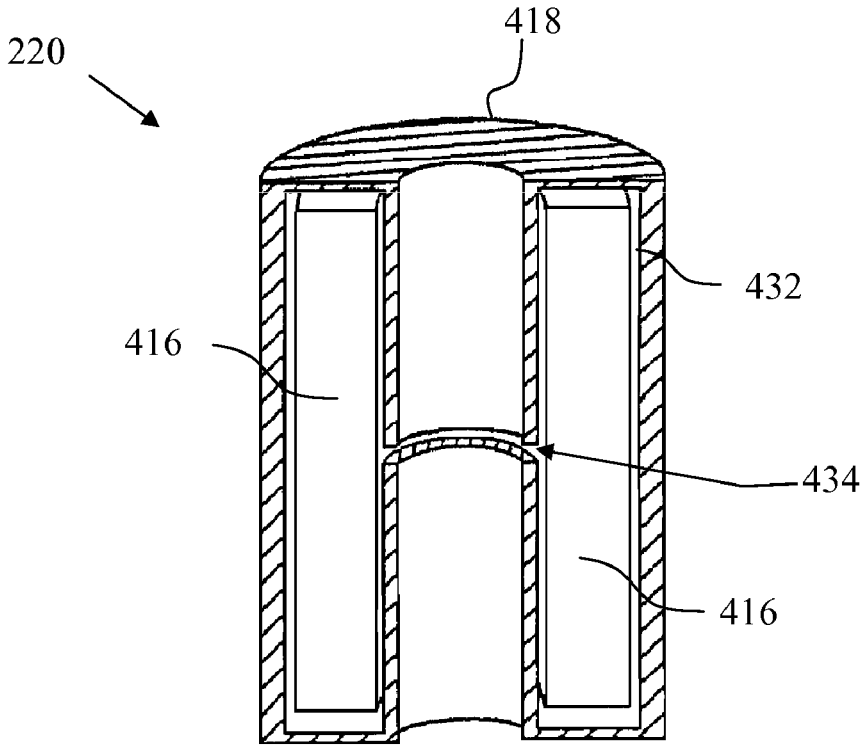

FIGS. 4A and 4B show multiple views of one embodiment of the MCCP 220. FIG. 4A shows a horizontal cross-section exposing the relationship of the ferrite core 416 and its primary winding 420 to a housing 418 and a feed connector 222. FIG. 4B shows a vertical cross-section of one half of the MCCP 220. In FIG. 4B, the ferrite core 416 can be split lengthwise into two halves.

Figure 4C:
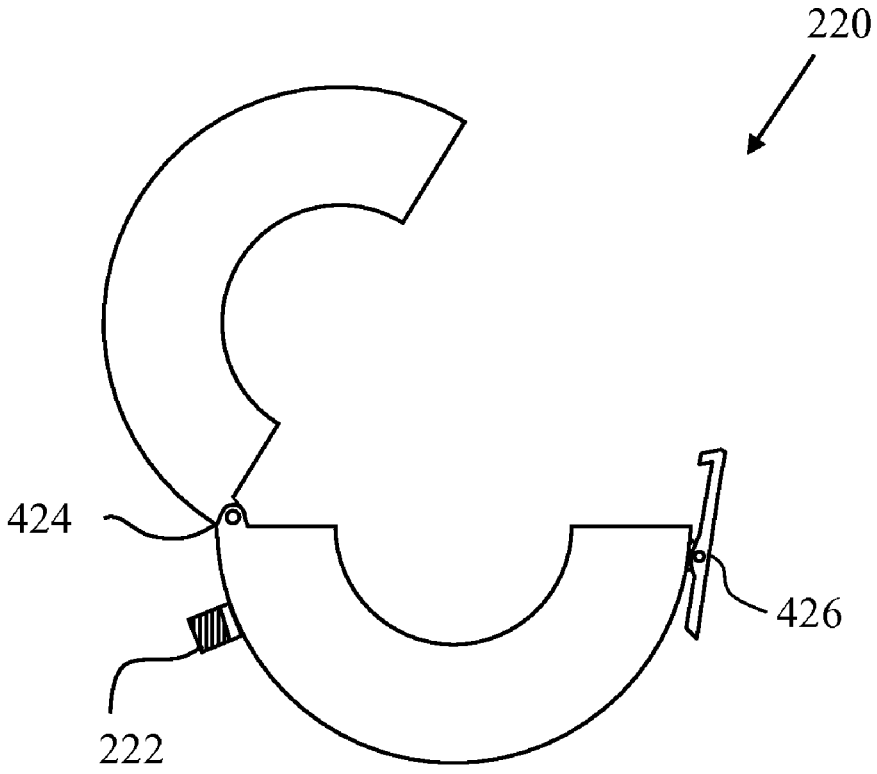

The embodiment of the MCCP 220 shown in FIGS. 4A and 4B may be clamped around a mast 140 (or other similar structure usable as an antenna), with FIGS. 4A and 4C showing features that allow such embodiments to be so clamped. A hinge 424 allows this embodiment of the MCCP 220 to be hinged open and positioned around the mast 140. In this embodiment, a releasable latch 426 allows the two core halves to be latched together. FIG. 4C shows an embodiment of the MCCP 220 in an open position. Although FIGS. 4A-4C show the MCCP 220 as configured to be clamped around a pole-like/mast structure, it is to be understood that the manner of mounting the MCCP 220 is not limited to clamping, but any effective manner of positioning of the MCCP 220 may be used.

Returning to FIG. 4A, the ferrite core 416 and primary winding 420 are contained within the housing 418. The ferrite core 416 may be comprised of any suitable magnetic material with a high resistivity. The primary winding 420 may be wound around the ferrite core 416 for a plurality of turns. The number of turns of the primary winding 420 and the ferrite core 416 materials will provide different inductive and resistive characteristics, affecting the frequency response and thus the insertion loss of the device. The primary winding 420 may consist of a single turn around the ferrite core 416 or several turns around the ferrite core 416. The primary winding 420 may cover only one half of the ferrite core 416, or may extend around both core halves. The primary winding 420 may be terminated with a connection to the housing 418 as a ground, or it can be terminated in a balanced to unbalanced transformer (typically referred to as a BALUN) as described below. For transmitting, an RF signal can be coupled into the MCCP 220 through the feed connector 222. Examples of usable feed connectors include, but are not limited to: BNC (bayonet Neill-Concelman), SMA (SubMiniature version A), TNC (threaded Neill-Concelman), and N-style coaxial connectors. If a coaxial connector is used, the shield 428 portion of the connector 222 can be coupled to the housing 418, while the inside conductor 430 of the connector 222 is coupled to the primary winding 420. The primary winding 420 is terminated with a connection to the housing 418. The primary winding 420 and ferrite core 416 may be insulated from the housing 418 by an electrical insulating layer 432. The insulating layer 432 may comprise any suitable electrical insulating materials. The core halves of the ferrite core 416 are generally in contact with each other when the MCCP 220 is closed, but, in some instances, an intentional air gap may separate the core halves. However, even when the core halves are in contact with each other, a minute air gap may still exist even though the core faces may be polished to a very smooth finish and pressed tightly against one another. This air gap may result in air gap losses. The so-called air gap loss does not occur in the air gap itself, but is caused by the magnetic flux fringing around the gap and reentering the core in a direction of high loss. As the air gap increases, the fringing flux continues to increase, and some of the fringing flux strikes the core perpendicular to the core, and sets up eddy currents. Core materials with high resistivity may reduce these currents.

FIG. 4B shows a space gap 434 within the interior portion of the housing 418. This space gap 434 may be used to prevent forming a shorted tertiary turn around the primary winding 420. If no space gap 434 were present, the shorted turn of the shield 428 would prevent the MCCP 220 from coupling RF current to and from the mast 140. Note that this shorted (or open) tertiary turn of shield 428 may act as the "second terminal" mentioned above with respect to FIGS. 2 and 3.

For transmitting, current flow in the primary winding 420 can induce a magnetic field with closed flux lines substantially parallel to the ferrite core 416. This magnetic field can then induce current flow in the mast 140 clamped within the MCCP 220, which results in RF energy radiation. A transmission line transformer may be used to couple the RF energy from a transmitter to the MCCP 220. If the primary winding 420 is terminated to the housing 418, an unbalanced to unbalanced (UNUN) transmission line transformer may be used to couple RF energy to the input end of the primary winding 420 of the MCCP 220. A balanced to unbalanced transformer (BALUN) may alternatively be used to couple RF energy to the MCCP 220. In this configuration, the primary winding 420 may not be terminated at the housing 418. Instead, both the input end and the termination of the primary winding 420 may be connected to the balanced terminals of a BALUN. The unbalanced ends of the BALUN may be connected to a coaxial cable carrying the RF energy from a transmitter. A BALUN may also be used if the RF current injector has no external shield connected to ground. Both BALUNs and UNUNs are well known in the art and are commercially available. However, specially made UNUNs may possibly be required to properly match a transmitter output to the input of the MCCP 220.

Figure 5:
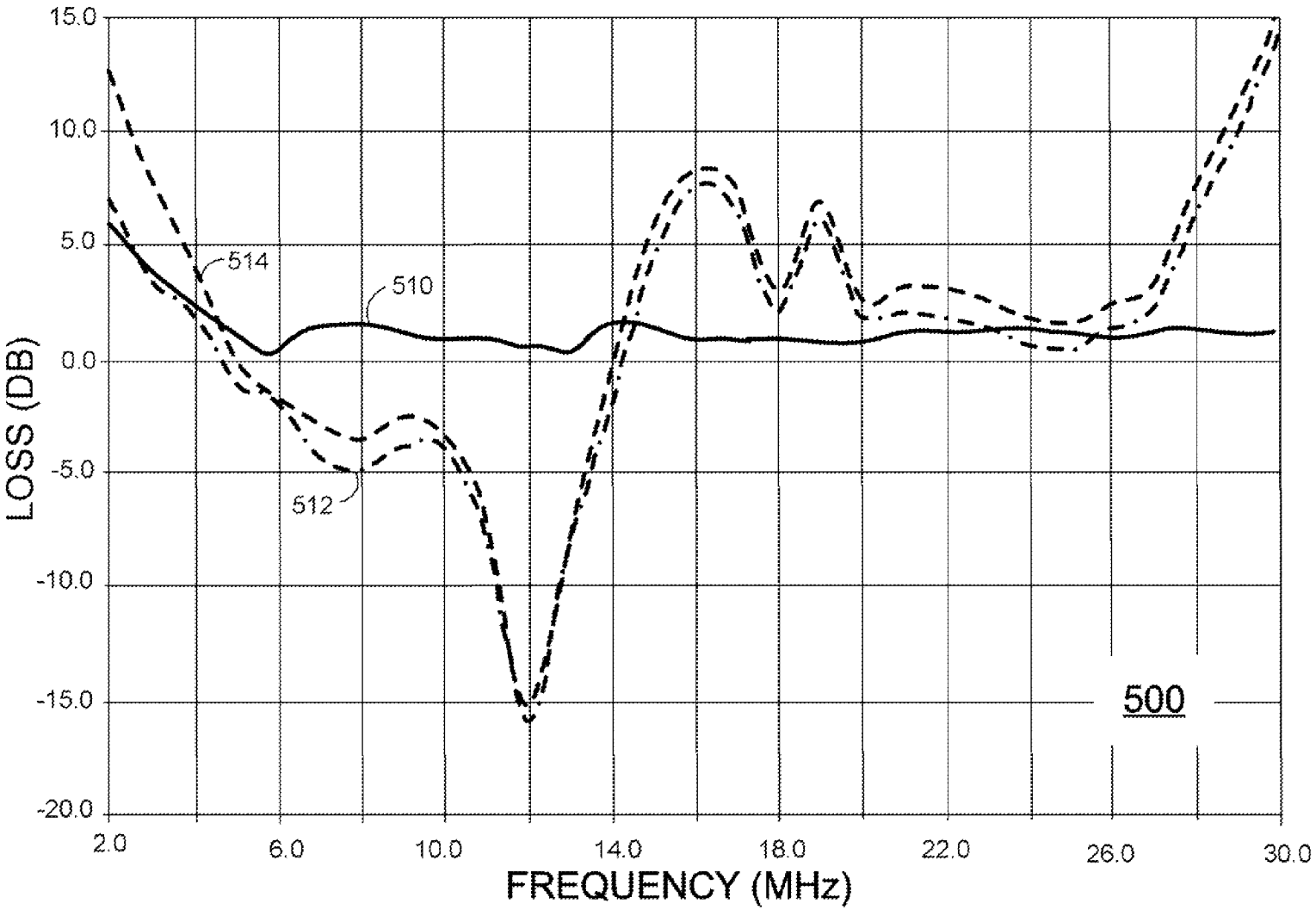
FIG. 5 depicts the characteristics of an exemplary MCCP mounted 5' above the base on the 35' whip monopole antenna.

FIG. 5 is a bode plot 500 depicting the loss characteristics of an exemplary MCCP mounted five feet above the base on a 35 foot whip monopole antenna. As shown in FIG. 5, the bode plot 500 includes three lines including a mismatch (MM) loss curve 510, an insertion loss curve 512 and a total loss curve 514. All of the curves 510-514 were generated using the approach described above with respect to FIGS. 2 and 3.

Figure 6:
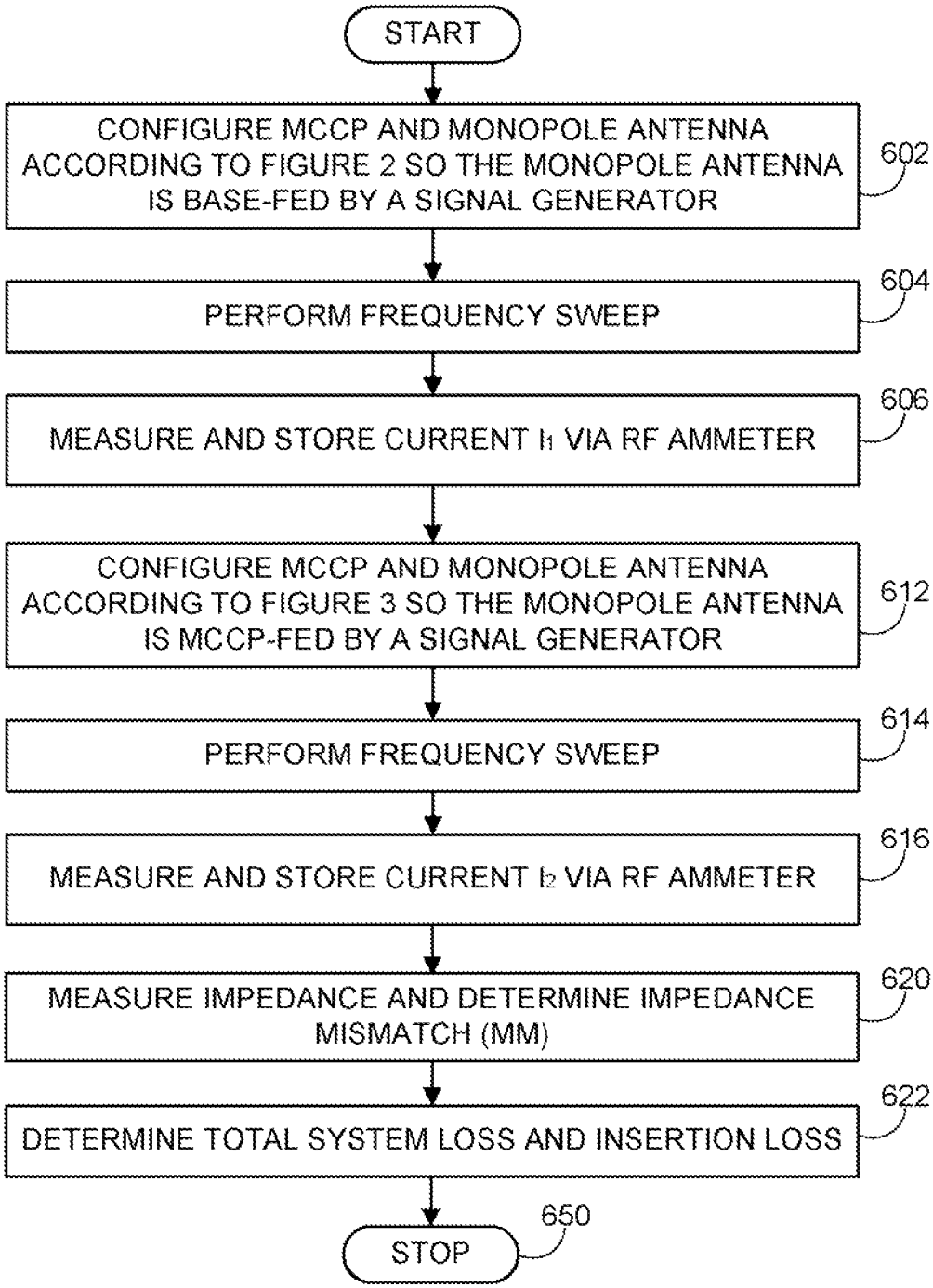
FIG. 6 is a flowchart outlining exemplary operations for evaluating insertion loss of a mast antenna.

FIG. 6 is a flowchart outlining exemplary operations for evaluating insertion loss of a monopole antenna. The process starts in step 602 where the monopole antenna is outfitted with an MCCP and configured with a test set according to the example of FIG. 2, i.e., a base-feed configuration. Next, in step 604, a signal generator may be made to base-feed the monopole antenna over a first range of frequencies, e.g., 2 MHz to 30 MHz. Then, in step 606, an RF ammeter at the base of the monopole antenna may be used to measure current $I_1$, which again is proportional to the power radiated by the monopole antenna. The measured current $I_1$ may then be provided to a computer and stored. Control continues to step 612.

In step 612, the monopole antenna and MCCP can be reconfigured with a test set according to the example of FIG. 3, i.e., an MCCP-feed configuration. Next, in step 614, a signal generator may be made to base-feed the monopole antenna over the first range of frequencies. Then, in step 616, the RF ammeter at the base of the monopole antenna may be used to measure current $I_2$, which again is proportional to the power radiated by the monopole antenna. Control continues to step 620.

In step 620, a network analyzer may be used to measure input impedance and determine impedance mismatch, and in step 622 total loss and insertion loss may be determined noting that the total loss and insertion loss may be determined using computing hardware. Control then continues to step 650 where the process stops noting that it should be appreciated that steps 602-622 may be repeated for a variety of configurations, e.g., where the MCCP is coupled at different points to the monopole antenna and/or where the monopole antenna is modified (by lengthening or shortening) or by extending a wire from the top of the monopole antenna.

What has been described above includes examples of one or more embodiments. It is, of course, not possible to describe every conceivable combination of components or methodologies for purposes of describing the aforementioned embodiments. It will, therefore, be understood that many additional changes in the details, materials, steps and arrangement of parts, which have been herein described and illustrated to explain the nature of the invention, may be made by those skilled in the art within the principle and scope of the invention as expressed in the appended claims.

What is claimed is:

1. A method for determining insertion loss for a mast clamp current probe (MCCP) coupled to a monopole antenna, the method comprising:

determining a first power radiated by the monopole antenna across a first range of frequencies while driving the monopole antenna using a base-feed arrangement to produce a first power-frequency measurement;

determining a second power radiated by the monopole antenna across the first range of frequencies while driving the monopole antenna using an MCCP-feed arrangement to produce a second power-frequency measurement;

determining impedance mismatch (MM); and determining insertion loss using the first power-frequency measurement, the second power-frequency measurement and the impedance mismatch.

2. The method of claim 1, wherein the step of determining the first power radiated by the monopole antenna includes configuring the MCCP with an open circuit primary terminal and a short-circuited second terminal while feeding a signal incorporating the first range of frequencies at a point close to a base of the monopole antenna, wherein the MCCP remains isolated from the monopole antenna.

3. The method of claim 2, wherein the step of determining the first power radiated by the monopole antenna further includes taking a current measurement from a point on the monopole antenna close to its base.

4. The method of claim 1, wherein the step of determining the second power radiated by the monopole antenna includes feeding a signal incorporating the first range of frequencies to the MCCP while the MCCP and monopole antenna are electrically insulated with respect to one another.

5. The method of claim 4, wherein the step of determining the second power radiated by the monopole antenna further includes taking a current measurement from a point on the monopole antenna close to its base.

6. A system for determining insertion loss for a mast clamp current probe (MCCP) coupled to a monopole antenna, the system comprising:

first testing means for determining a first power radiated by the monopole antenna across a first range of frequencies while driving the monopole antenna using a base-feed arrangement to produce a first power-frequency measurement;

second testing means for determining a second power radiated by the monopole antenna across the first range of frequencies while driving the monopole antenna using an MCCP-feed arrangement to produce a second power-frequency measurement;

third testing means for determining impedance mismatch (MM); and computer equipment operable to determine insertion loss using the first power-frequency measurement, the second power-frequency measurement and the impedance mismatch.

7. The system of claim 6, wherein the first testing means for determining the first power radiated by the monopole antenna includes a signal generator operable to feed a signal incorporating the first range of frequencies at a point close to a base of the monopole antenna while a second terminal of the MCCP is shorted with an electrical conductive tape and isolated respect to the monopole antenna.

8. The system of claim 7, wherein the first testing means for determining the first power radiated by the monopole antenna further includes a current measurement device coupled between the signal generator and a point on the monopole antenna close to its base.

9. The system of claim 6, wherein the second testing means for determining the second power radiated by the monopole antenna includes a signal generator operable to feed a signal incorporating the first range of frequencies to the MCCP while the MCCP is electrically isolated from the monopole antenna.

10. The system of claim 9, wherein the second testing means for determining the second power radiated by the monopole antenna further includes a current measurement device coupled between ground and a point on the monopole antenna close to its base.

11. A system for determining insertion loss for a mast clamp current probe (MCCP) coupled to a monopole antenna, the method comprising:

a base-feed test set that includes a signal generator and a current measuring device, wherein the signal generator is operable to drive the monopole antenna across a first range of frequencies using a base-feed arrangement while the current measuring device is operable to measure a first current of the monopole antenna, wherein a first power-frequency measurement may be determined using the first measured current;

an MCCP-feed test set that also includes a signal generator and a current measuring device, wherein the signal generator is operable to drive the monopole antenna across a first range of frequencies via the MCCP while the current measuring device is operable to measure a second current of the monopole antenna, wherein a second power-frequency measurement may be determined using the second measured current, and wherein the MCCP-feed test set is operable to determine impedance mismatch (MM); and computer equipment operable to determine insertion loss using the first measured current, the second measured current and the impedance mismatch.

12. The system of claim 11, wherein signal generator of the base-feed test set is operable to feed a signal incorporating the first range of frequencies at a point close to a base of the monopole antenna while the MCCP second terminal is shorted and isolated respect to the monopole antenna.

13. The system of claim 12, wherein current measuring device of the base-feed test set is coupled between the signal generator and a point on the monopole antenna close to its base.

14. The system of claim 11, wherein signal generator of the MCCP-feed test set is operable to feed a signal incorporating the first range of frequencies to the MCCP while the MCCP is electrically isolated from the monopole antenna.

15. The system of claim 14, wherein current measuring device of the MCCP-feed test set is coupled between ground and a point on the monopole antenna close to its base.

* * * * *